United States Patent [19]

Furuichi et al.

[11] Patent Number: 4,637,555

[45] Date of Patent: Jan. 20, 1987

[54] CIRCULATION TYPE HOMOGENIZING APPARATUS

[75] Inventors: Akira Furuichi, Nishinomiya; Akira Iijima, Takatsuki, both of Japan

[73] Assignee: Tokushu Kika Kogyo Kabushiki Kaisha, Osaka, Japan

[21] Appl. No.: 643,002

[22] Filed: Aug. 21, 1984

[30] Foreign Application Priority Data

Oct. 24, 1983 [JP] Japan ..... 58-197622

[51] Int. Cl.[4] ..... B02C 7/08

[52] U.S. Cl. ..... 241/46.02; 241/46 B; 241/46.06; 241/97; 241/101.2; 241/199.12; 241/246; 241/261.2

[58] Field of Search ..... 241/46 R, 46 B, 46.02, 241/46.06, 46.04, 46.11, 46.17, 97, 98, 101.2, 235, 242, 257 R, 258, 261.2, 199.12, 245, 101 R, 101 B, 199.9, 246, 46 A, 257 G

[56] References Cited

U.S. PATENT DOCUMENTS

| | | | |
|---|---|---|---|
| 1,074,299 | 9/1913 | Strack | 241/97 |
| 1,127,615 | 2/1915 | Gilligan | 241/46 R |
| 2,122,400 | 7/1938 | Anderson | 241/101.2 X |
| 2,129,789 | 9/1938 | Seaborne | 241/246 X |
| 2,580,579 | 1/1952 | Neenan | 241/46.04 X |
| 4,050,636 | 9/1977 | Possell et al. | 241/46.11 X |
| 4,253,613 | 3/1981 | Reinhall | 241/261.2 X |

FOREIGN PATENT DOCUMENTS

| | | | |
|---|---|---|---|
| 206376 | 12/1956 | Australia | 244/199.12 |
| 1011653 | 7/1957 | Fed. Rep. of Germany | 241/199.12 |

*Primary Examiner*—Howard N. Goldberg
*Assistant Examiner*—Joseph M. Gorski
*Attorney, Agent, or Firm*—Michael N. Meller

[57] ABSTRACT

A circulation type homogenizing apparatus for treating raw material liquids, which utilizes a main cylindrical barrel with a subsidiary barrel centrally located therein and a pair of mating grinding disks arranged to provide a homogenizing action for the liquid passed therethrough. The raw feed liquid containing fine particulate solids is introduced into the main barrel and centrifugally forced from the lower stationary portion of an inner subsidiary barrel by rotary tandem blade tubes into the gap between the mating grinding disks. Both grinding disks have teeth and grooves on the grinding surfaces, and the upper disk is rotated relative to the stationary lower disk by a driving motor mounted above the main barrel. From the grinding disks a portion of the homogenized liquid is recirculated back through the subsidiary barrel and grinding disks gap for further treatment, while the remainder of the homogenized material is withdrawn from around the upper end of the main barrel.

10 Claims, 3 Drawing Figures

CIRCULATION TYPE HOMOGENIZING APPARATUS

BACKGROUND OF INVENTION

This invention relates to a homogenizing apparatus and to a method used for treating a raw material liquid containing fine particulate solids. Such a liquid contains pigments for cosmetics or paints or iron oxides for a magnetic tape or the like to produce a homogenized liquid product.

As for a homogenizing apparatus of this kind, there has been hitherto proposed by the applicant an apparatus for a raw material liquid to be treated. Such material to be homogenized is charged into a treating tank comprising a main barrel, a subsidiary barrel together with a circulation of the liquid around the inside and outside of the subsidiary barrel. This is repeated, so that there may be created a cavitation for progressive mixing and emulsification of the liquid. This type of apparatus, however, is inconvenient because it depends only on repeated circulation operations and a large number of circulation operations must be carried out in order to obtain a predetermined result. Accordingly the necessary time for treatment becomes long. Additionally, because the circumferential speed of a blade tube for flowing the liquid must usually be above 20 m/sec. in order to homogenize particles by cavitation, there is generated a considerable amount of undesirable noise.

SUMMARY OF INVENTION

This invention has as its principal object the provision of a homogenizing apparatus and a method in which the foregoing defects with conventional homogenizing apparatus are eliminated. This is made possible because a grinding operation is used jointly with repeated liquid circulation operations, so that the number of repeated circulations of the liquid is decreased so as to enable a predetermined result to be obtained in a shorter time. Also, the circumferential speed of a blade tube can be lowered to only about 10 m/sec. for obtaining a predetermined result, and therefore any difficulties caused by noise generation can be substantially reduced.

The invention is characterized in that a stationary main barrel that is provided with a covering plate and has an overflow space left over above the barrel upper edge thereof adjacent the cover plate is provided at its lower portion with a supply opening for a raw material liquid to be treated. A subsidiary barrel which is open at its upper and lower ends is fixedly provided in the stationary main barrel so as to form an annular space therearound and is provided at its upper portion with a pair of upper and lower grinding disks having their respective annular grinding surfaces facing one another.

The lower grinding disk is fixed to an upper part of the subsidiary barrel and the upper grinding disk is in the form of a dish and is connected to a driving shaft inverted through the subsidiary barrel from above into a central portion of the subsidiary barrel and is positioned to cover a lower part of the subsidiary barrel. Thus, there is confined below the upper grinding disk a blind liquid passage. There is also a blade tube for flowing the raw material liquid in the centrifugal direction towards the facing portion of the upper and lower grinding disks and a blade tube for flowing the raw material liquid in the upper direction fixedly mounted in upper and lower relationships on such a portion of the driving shaft that projects into the blind liquid passage.

In this manner there is formed such a circulation flow passage that the raw material liquid supplied into the main barrel is directed upwards into the blind liquid passage in the subsidiary barrel from the lower end opening thereof. This is passed through the gap between the upper and lower grinding disks, and is then directed downwards through the annular space outside the subsidiary barrel and is again introduced into the subsidiary barrel thereof through the lower end opening thereof.

BRIEF DESCRIPTION OF DRAWINGS

One useful embodiment of this invention will now be described with reference to the accompanying drawings.

DETAILED DESCRIPTION OF INVENTION

Figure 1:
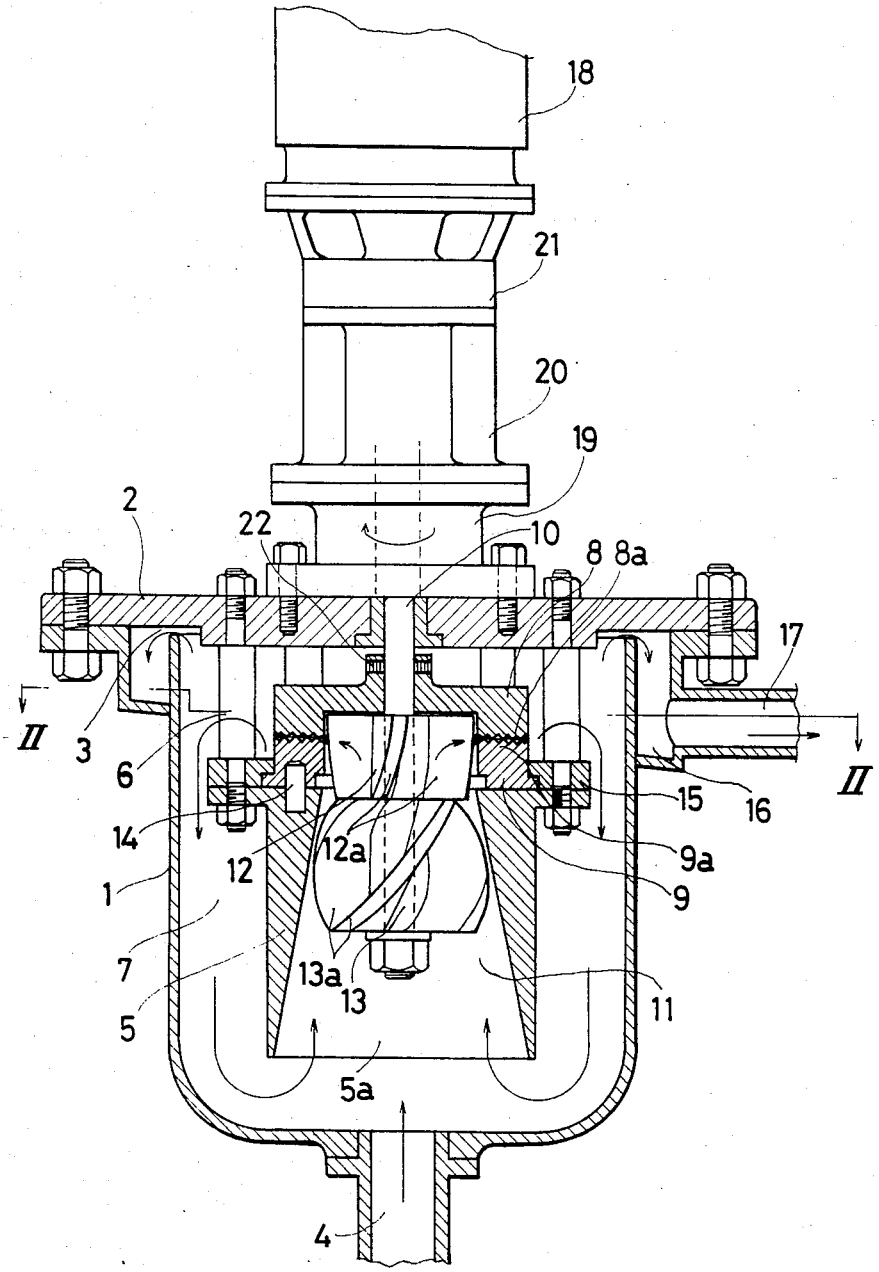
FIG. 1 is a sectional side view of an important portion of one embodiment of this invention.

As shown in the drawings, numeral 1 denotes a cylindrical type stationary main barrel, which has a covering plate 2 attached to an upper surface thereof, so as to form an overflow space 3 between an upper edge of the main barrel 1 and the covering plate 2. By this construction, a proper amount of a raw material liquid treated in the main barrel 1 may be flowed over the upper edge of the main barrel 1 as is described in more detail hereinafter. The main barrel 1 is provided at its bottom portion with a supply opening 4 for the raw material liquid being treated.

Numeral 5 denotes a subsidiary barrel which is fixedly provided within the main barrel 1 by being supported from the covering plate 2 through a hanging means 6, such as a plurality of elongated bolts with spacers. The barrel 5 is disposed coaxially with the main barrel 1 so that an annular space 7 serving as a liquid passage is formed between the inner subsidiary barrel 5 and the inner circumferential surface of the main barrel 1.

The subsidiary barrel 5 is provided at its upper portion with a pair of upper and lower grinding disks 8, 9 respectively, each having respective annular grinding surfaces *8a, 9a* facing one another. The lower grinding disk 9 is rigidly connected through a stopper pin 14 to a lower part of the subsidiary barrel 5 so as not to be rotatable. In addition, grinding disk 9 is prevented from being floated upwards by an annular member 15 also attached to bolts 6. The upper grinding disk 8 is in the form of an inverted dish, and is fixed to a driving shaft 10, which is inserted through the covering plate 2 of the main barrel 1 so as to project into the subsidiary barrel 5. It is thus rotatable together with the driving shaft 10. Consequently, the grinding disks 8, 9 facing each other serve to close an upper end opening portion of the subsidiary barrel 5 and to form the interior of the subsidiary barrel 5 into a blind liquid passage which is in communication at its lower end opening *5a* with the interior of the main barrel 1.

The blind liquid passage 11 is provided at an upper portion of the interior thereof with a blade tube 12 having a blade member *12a* for flowing the raw material liquid in a radial or centrifugal direction towards a gap formed between the interfacing grinding surfaces *8a, 9a* of the overlapped grinding disks 8, 9. Also, blind liquid passage 11 is provided at a lower portion of the interior thereof with a blade tube 13 having a blade member 13*a* for flowing the raw material liquid upwards along the axial direction thereof, and these blade tubes 12, 13 are fixedly connected to the driving shaft 10 so as to be rotatable therewith.

Figure 3:
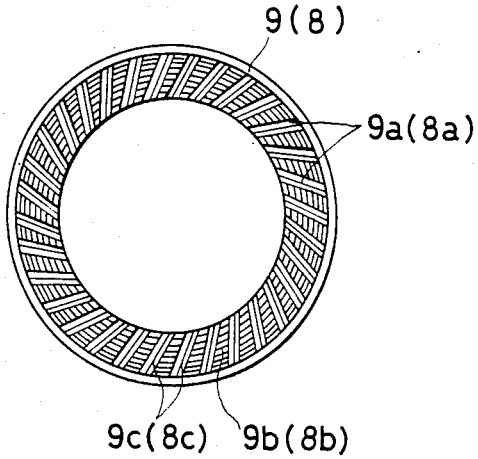
FIG. 3 is a top plan view of a grinding disk showing typical teeth arrangement used in the invention.

Each of the annular grinding surfaces 8*a*, 9*a* of the upper and lower grinding disks 8, 9 respectively, may be of the type that, as shown in FIG. 3, for instance, a large number of fine teeth and grooves 8*b*, 9*b* in the form of concentric circles are made in the metallic disk surfaces. These circular teeth 8*b*, 9*b* are divided by radially traversing grooves 8*c*, 9*c* into a large number of separate grinding sections. Otherwise, the annular grinder surfaces may be formed by using a hard alundum or carborundum grinding stone material. The gap spacing or width between the grinding surfaces 8*a*, 9*a* facing one another may be so arranged as to be adjustable by any desired means, such as shims located between hanging member 6 and the annular clamping member 15.

Figure 2:
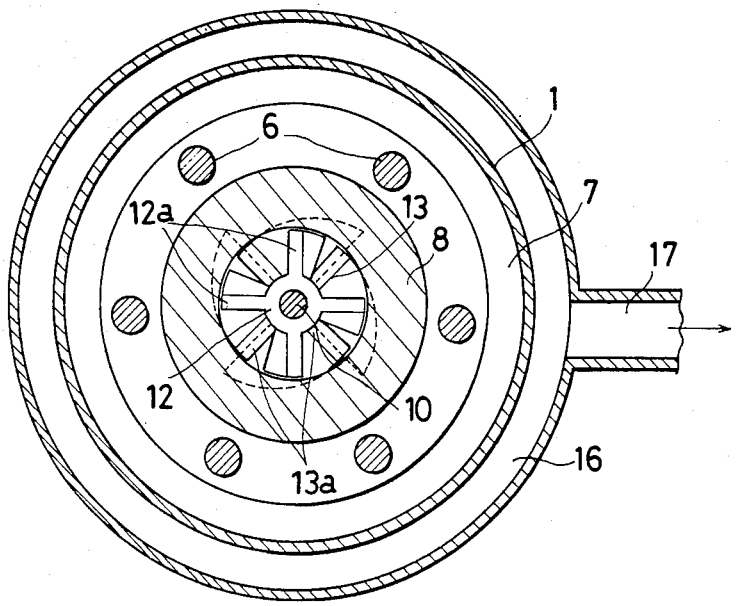
FIG. 2 is a sectional plan view taken along the line II—II of FIG. 1.

Referring to FIGS. 1 and 2, numeral 16 denotes an annular receiving conduit formed to surround the outer periphery of an upper portion of the main barrel 1, and the conduit 16 is provided with a discharging pipe 17 extending from one side thereof.

In the illustrated embodiment, the driving shaft 10 is arranged to be driven by an electric motor 18 preferably mounted on the covering plate 2 of the main barrel 1. As shown in FIG. 1, a sealing box 19 is rigidly attached on its lower side to cover plate 2 and is also attached to a bearing casing 20 and an attaching base 21 for the motor 18. However, a useful modification can be considered such that the motor 18 is provided at a position which is remote from the main barrel 1, and the shaft 10 is arranged to be driven thereby through a belt transmission means. Numeral 22 denotes an adjusting screw.

Next, the operation of the homogenizing apparatus will be explained as follows:

The driving shaft 10 is rotated while the raw material liquid to be treated is continuously charged into the main barrel 1 through the lower supply opening 4. The raw material liquid is caused, at first to flow, by rotating of the lower blade tube 13 thereof, upwards into the blind liquid passage 11 in the subsidiary barrel 5 from the lower end opening 5*a*. Next, the liquid in the blind liquid passage 11 is then caused to flow, by rotation of the upper blade tube 12 outwardly in the radial or centrifugal direction for being driven into the gap formed between the grinding surfaces 8*a*, 9*a* of the upper and lower grinding disks 8, 9, respectively, whereby particles in the liquid are finely divided by the grinding action caused by the grinding surfaces 8*a*, 9*a*. Thereafter, the liquid is discharged outside the outer periphery of subsidiary barrel 5 through the gap by the centrifugal action and is then directed downwards through the annular space 7 between the main barrel 1 and the subsidiary barrel 5, and thereafter is flowed back to be introduced again into the subsidiary barrel 5 through the lower end opening 5*a* of the barrel 5. During this liquid circulation operation, particles in the raw material liquid are roughly divided by the blade tubes 12, 13 and are further ground to be finely grained when passed through the grinding gap between the grinding surfaces 8*a*, 9*b*. Through the repeated liquid circulation operations, such a portion of the liquid that has been homogenized increases in viscosity, so that the same becomes slower in circulation and as a result is separated from the main circulation flow of the liquid and is accumulated near the upper circular edge portion of the main barrel 1. Thereby the liquid is discharged in an orderly and automatic manner through the overflow space 3 for being removed through the discharging pipe 17.

If, in the foregoing circulation type homogenizing operation, the liquid amount supplied into the main barrel 1 in relation to the liquid amount circulating in the main barrel 1 is set to be a small fraction, the raw material liquid is recirculated several times corresponding thereto, and the fractional amount thereof, corresponding to the supply amount, is discharged. Accordingly, by controlling the supply amount, the number of recirculation times, that is, the number of passing times through the grinding portion can be adjusted to obtain a desired homogenizing effect. The taken-out amount of the homogenized liquid can be adjusted in accordance with the supply amount and additionally the liquid homogenized to a desired degree is accumulated at the upper portion in the main barrel 1 and is taken out in an orderly manner without any relation to the circulation main flow in the barrel. The thus homogenized liquid containing uniformly fine grained particles can then be withdrawn.

Thus, according to the present invention, a stationary main barrel, an inner subsidiary barrel, a pair of upper and lower grinding disks and a pair of upper and lower blade tubes are so disposed within the subsidiary barrel that there is formed a circulation flow passage in which a raw material liquid to be treated is flowed upwardly into the subsidiary barrel and thereafter is flowed centrifugally through a narrow gap between the grinding disks and is then recirculated into the subsidiary barrel. In addition, there is provided a grinding portion extending along the centrifugal directional flow passage, so that in comparison with the conventional homogenizing effect caused by the liquid cavitation, the finely-divided effect on particles in the liquid can be remarkably improved because the same depends on the mechanical grinding operation. Additionally, because the finely-dividing effect by the cavitation is not an object, a driving shaft for circulation operation can be decreased to a low speed, and accordingly, any difficulties because of excess noise generation can be attenuated.

Although this invention has been disclosed broadly and in terms of a preferred embodiment, it is understood that various modifications can be made within the scope of the invention, which is defined by the following claims.

We claim:

1. A liquid homogenizing apparatus for continuously charging and treating a raw material liquid containing fine particulate solids, comprising:

(a) a stationary main barrel attached to a cover plate, said main barrel being provided at its lower portion with an opening for supply of a raw material liquid to be treated, and having an overflow space located above its upper edge and beneath said cover plate;

(b) a subsidiary barrel fixedly supported within said main barrel, so as to form an annular space between said main barrel and said subsidiary barrel, said subsidiary barrel being open at its lower end directly above and opposite the supply opening in the main barrel and provided at its upper portion with an upper grinding disk and a lower grinding disk, said grinding disks having a gap therebetween and having their respective annular grinding surfaces facing each other, said lower grinding disk being fixed to a lower portion of the subsidiary barrel and the upper grinding disk being connected to a rotary drive shaft that is inserted through said cover plate into a central portion of the subsidiary barrel so as to provide a blind liquid passage;

(c) an upper rotatable blade tube attached to said drive shaft for flowing the raw material liquid in the upper portion of said subsidiary barrel in a radial direction towards the grinding surfaces of the upper and lower grinding disks; and (d) a lower rotatable blade tube means attached to said drive shaft and located beneath said upper rotatble blade tube for flowing the raw material liquid in an upward direction, so as to enable the raw material liquid supplied into said main barrel to be directed from the lower open end of the subsidiary barrel upwards into said blind liquid passage and then passed through the gap between the upper and lower grinding disks with a portion of the liquid capable of being circulated downwards through the annular space outside the subsidiary barrel and through the lower end opening of the subsidiary barrel in order to obtain a homogenized liquid product.

2. A liquid homogenizing apparatus according to claim 1, wherein said grinding surfaces are provided with a plurality of teeth and grooves.

3. A liquid homogenizing apparatus according to claim 2, wherein said teeth are separated by grooves oriented in both radial and circumferential directions.

4. A liquid homogenizing apparatus according to claim 1, wherein said lower portion of said subsidiary barrel is held stationary by a plurality of bolts attached to the cover plate, while said upper portion is rotated by said driving shaft.

5. A liquid homogenizing apparatus according to claim 1, wherein said subsidiary barrel is located concentrially within said main barrel.

6. A liquid homogenizing apparatus according to claim 1, wherein said supply opening is centrally located in the lower portion of said main barrel.

7. A liquid homogenizing apparatus according to claim 1, wherein said main barrel has an annular overflow space located at the upper edge of the main barrel adjacent said cover plate for removal of the homogenized liquid.

8. A liquid homogenizing apparatus according to claim 1, wherein said upper grinding disk has an inverted dish form.

9. A liquid homogenizing apparatus according to claim 1, wherein said shaft is driven by a direct-connected motor mounted onto the cover plate above said main barrel.

10. A liquid homogenizing apparatus according to claim 1, wherein said annular grinding surfaces are formed of a hard grinding stone material selected from the group consisting of alundum and carborundum.

* * * * *